US005878441A

United States Patent [19]

Busker et al.

[11] Patent Number: 5,878,441

[45] Date of Patent: Mar. 9, 1999

[54] WATER-IMPERVIOUS POCKET

[76] Inventors: Dan L. Busker, 6303 Tutbury, Troy, Mich. 48098; Mark I. Frick, 25996 Balsam, Franklin, Mich. 48025

[21] Appl. No.: 845,947

[22] Filed: Apr. 30, 1997

Related U.S. Application Data

[63] Continuation of Ser. No. 251,789, May 31, 1994, abandoned.

[51] Int. Cl.[6] ..... A41D 27/20

[52] U.S. Cl. ..... 2/247; 2/250

[58] Field of Search ..... 2/311, 67, 312, 2/314, 317, 247, 338, 250; 40/586; 383/42, 63, 64, 901

[56] References Cited

U.S. PATENT DOCUMENTS

| | | | |
|---|---|---|---|
| 1,712,109 | 5/1929 | Hammer | 2/247 X |
| 2,474,495 | 6/1949 | Pollak | 2/247 |
| 2,514,750 | 7/1950 | Dobbs et al. | 383/63 X |
| 2,709,815 | 6/1955 | Nelson | 2/247 |
| 3,137,862 | 6/1964 | Mizerak | 2/247 |
| 4,854,017 | 8/1989 | Kamp | 383/63 X |
| 4,862,521 | 9/1989 | Mann | 2/160 |
| 5,056,933 | 10/1991 | Kamp | 383/63 |
| 5,165,115 | 11/1992 | Stanislaw | 2/247 |
| 5,255,392 | 10/1993 | Stanislaw | 2/247 |
| 5,540,366 | 7/1996 | Coomber | 383/63 X |
| 5,645,205 | 7/1997 | Kennedy | 224/676 |

*Primary Examiner*—Gloria M. Hale
*Attorney, Agent, or Firm*—Weintraub & Brady

[57] ABSTRACT

A waterproof pocket, usable in beach or boating environments, can hold articles therein while keeping the articles dry. The pocket is formed of a water-impervious material. A seal, such as a slide fastener or interlocking ridges, is formed to prevent water from entering the pocket. The pocket can be attached to clothing, particularly to a swim suit. Alternately, the pocket may be held in a slot or other similar opening in the clothing.

4 Claims, 2 Drawing Sheets

FIG 5
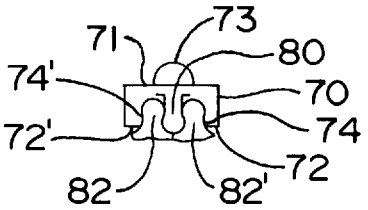
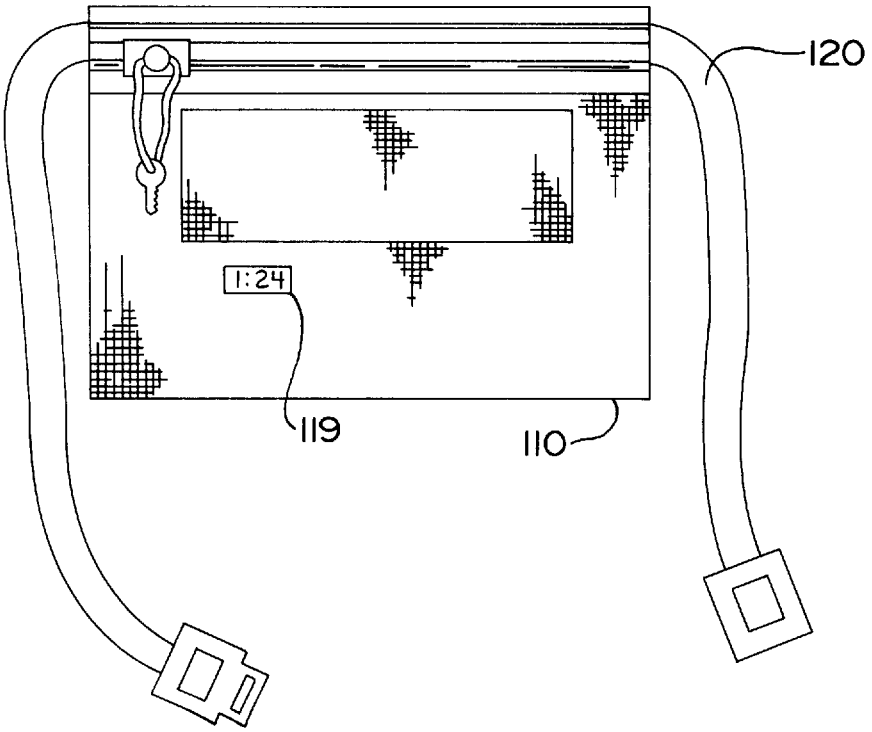
FIG 6

WATER-IMPERVIOUS POCKET

This is a continuation of application Ser. No. 08/251,789, filed May. 31, 1994 abandoned.

BACKGROUND OF THE INVENTION

1. Field of the Invention

The present invention concerns waterproof, sealable pockets. More particularly, the present invention concerns such sealable, water-impervious pockets deployed on clothing or otherwise deployable on the body of a user.

2. Prior Art

The formation of pouches that are waterproof, that is, formed of water-impervious material and having formed therein a releasable water-impervious seal, is known. A commonly known version of this type of pouch is the sealable food bag, such as that sold under the trademark "Ziplock".

Such a bag has been deployed in combination with a beach towel, as set forth in U.S. Pat. No. 4,195,378 issued Apr. 1, 1980 to Parker and entitled "MIULTIPURPOSE BEACH EQUIPMENT". Parker teaches a plurality of pouches formed at the top of a blanket. Each pouch is formed of a waterproof lining and sealed with a waterproof zipper.

As helpful as the Parker device is, Parker presents problems to a user. When at the beach or other water recreation, the Parker device will keep an article within a waterproof area. However, if the towel is unattended, the articles contained therein are vulnerable to theft. Further, the articles cannot be carried around in a waterproof pouch unless the entire towel is carried. Even if the entire towel is transported, it is bulky and cumbersome.

Additionally, there is the inherent problem in the environments where such waterproof devices are utilized of securing timepieces. Watches and similar devices are often not waterproof. Therefore, these timepieces must be taken off, where loss due to misplacing or theft is possible. Even if stored in a waterproof pouch, such time devices must be removed to be utilized.

What is needed is a waterproof, releasably sealable pocket that can be either permanently or releasably attached to a suit or other item of clothing or, alternately, to means for disposing the pouch on a user. Further, there is a need for such a pocket with a timepiece therein to facilitate the tracking of time. It is to this need that the present invention is directed.

SUMMARY OF THE INVENTION

The present invention is a water-impervious pocket attachable to an article of clothing. The pocket comprises:

(a) a first panel having a first edge and at least one additional edge, the first edge and each additional edge comprising a perimeter, the first panel being formed of a water-impervious material;

(b) a second panel having a first edge and at least one additional edge, the first edge and each additional edge comprising a perimeter of the second panel, the second panel being formed of a water-impervious material, the first panel and the second panel being joined together along the at least one additional edge of the panels, the first edges of each of the panels defining an opening;

(c) means for releasably sealing the first panel to the second panel; and (d) means for attaching the pocket to the article of clothing.

The pocket of the present invention prevents water from entering through the panels or the means for sealing. The seal may comprise a slide fastener, commonly termed as zipper, or a plurality of interlocking ridges. Preferably, the means for joining comprises a slide fastener facilitating the interlocking ridges. The means for attaching may comprise stitching to secure the pocket to the clothing. Alternately, the means for attaching may comprise an attaching flange or a Velcro fastener. In an alternate embodiment, the means for attaching may connect the pocket to a belt for deployment around the user.

The present invention will be more completely understood by the following detailed descriptions in conjunction with the accompanying drawings, in which like reference numerals refer to like elements and wherein:

BRIEF DESCRIPTION OF THE DRAWINGS

FIG. 5 is a cross-sectional view of the slide fastener deployed with the plurality of interlocking ridges; and FIG. 6 is a front view of the pocket of the present invention with means for disposing the pocket upon a wearer.

DETAILED DESCRIPTION OF THE PREFERRED EMBODIMENT

Referring now to FIGS. 1–6, there is seen the present invention, to wit, a water-impervious pocket 10. The pocket 10 comprises a first panel 12, a second panel 14 and means 16 for sealing the first panel 12 to the second panel 14.

Figure 1:
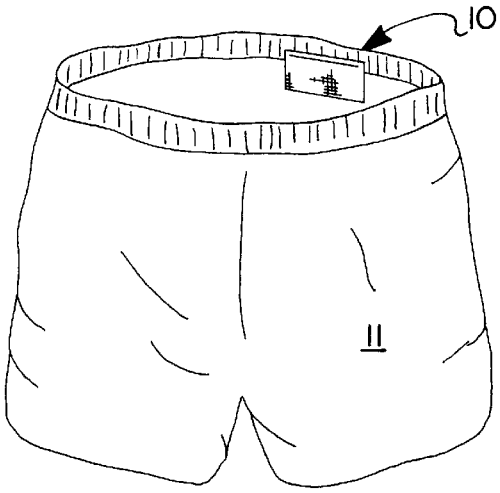
FIG. 1 is an environmental view of the pocket of the present invention attached to a pair of shorts.

As can be seen in FIG. 1, the pocket 10 is affixed to a pair of swimming trunks 11. The trunks 11 are shown as one preferred example Of the clothing to which the pocket 10 may be affixed. Other envisioned clothing to which the pocket 10 may be attached include sweat pants, shorts and T-shirts. Alternately, the pocket 10 could be connected to a belt 13, as shown in FIG. 6, allowing deployment of the pocket 10 proximate the waist of a user, as will be discussed further herein below. Suitable means for attaching to the clothing or belt are employed as are commonly known, such including sewing, gluing, fastening or the like.

Figure 2:
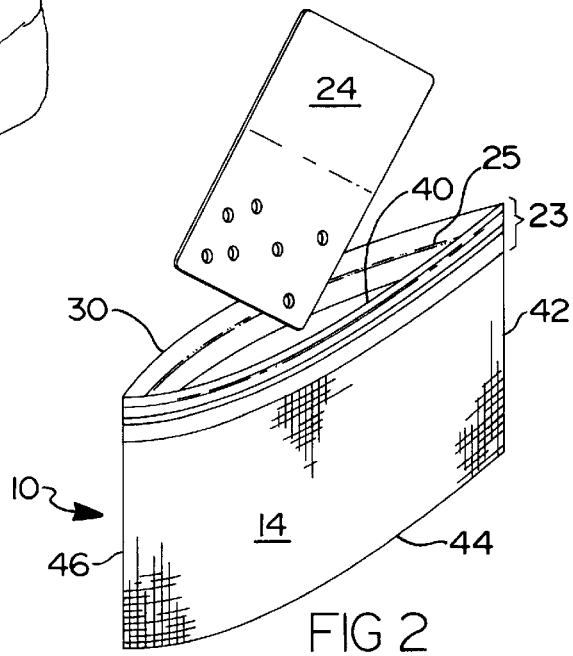
FIG. 2 is a perspective view of the rear of the pocket, with an exemplary article to be held therein.

Referring now to FIG. 2, the construction of the pocket 10 can be seen. The pocket 10 comprises a first panel 12 and a second panel 14. Each panel 12, 14, in the preferred embodiment, is formed in a quadrangular configuration, generally, and rectangular, particularly. It is envisioned that the panels 12, 14 may be formed in other configurations, including circular, square, triangular, etc.

Figure 3:
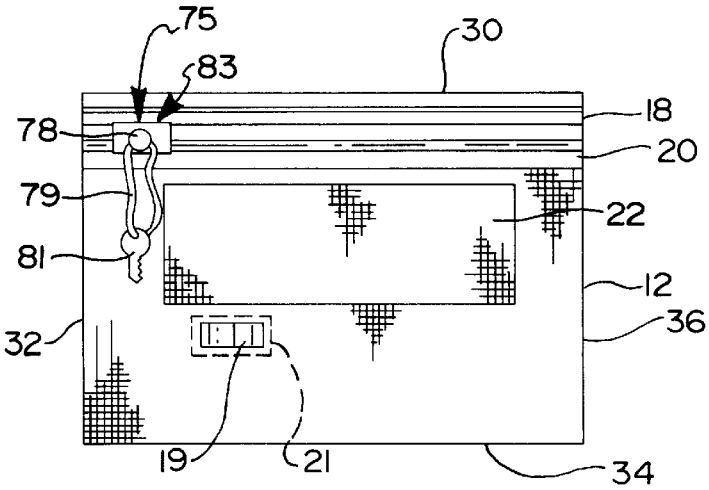
FIG. 3 is a front view of the pocket.

The panels 12, 14 are formed of a water-impervious material that is also flexible. One preferred material is plastic, although other materials, such as mylar or chemically treated fabric, could be utilized. As seen in FIGS. 1–3, the panels 12, 14 are covered by a mesh. The mesh covering prevents viewing of the contents, thus giving a measure of privacy to the pocket 10.

The panels 12, 14 each comprise an upper edge 30, 40, a first side edge 32, 42, a bottom edge 34, 44, and a second side edge 36, 46, respectively. What is critical to note is that the pocket 10 has on each panel 12, 14 an upper edge 30, 40 and at least one additional edge, the upper edge 30, 40 and at least one additional edge comprising a perimeter. It is conceivable, alternately, that the panels 12, 14 formed in a circular or oval shape will have only one edge, with other means for sealing being deployed along a portion of the perimeter thereof. In this case, the portion where the means for sealing is deployed is analogous to the upper edge and the remainder of the perimeter will be constructed to form the at least one additional edge. The panels 12, 14 are molded together or otherwise sealed to each other by suitable means, such as gluing, heat molding, sonic welding or the like, as area known in the art. The upper edges 30, 40 are not joined together, but rather cooperate to define an opening therebetween. The panels 12, 14 further define an interior therebetween, the interior defined by the side edges 32, 42, 36, 46 and the bottom edge 34, 44. As shown in FIG. 2, a hotel key 24 or other valuable is deployable into the interior of the pocket 10.

The panel 12 may further comprise a timepiece 19. The timepiece 19 is enclosed underneath the flexible material of the panel 12. One such means for enclosing the timepiece 19 would be a cover 21 (shown in phantom in FIG. 3 deployed behind the timepiece 19, the cover being formed of the flexible material. The cover 21 would then be fixed to the panel 12, by means similar to those used to connect the panels 12, 14. A clear portion or window is formed over the timepiece 19 so that the timepiece 19 is visible without accessing the pocket 10.

The pocket 10 further comprises means 16 for releasably sealing the first panel 12 to the second panel 14. The means 16 for sealing comprises, in a first embodiment, a plurality of interlocking members 18, 20. A first member 18 is deployed along the interior surface of the first panel 12 proximate the upper edge 30. The first member 18 comprises a plurality of ridges, the ridges 25 defining at least one channel therebetween. The second interlocking member 20 comprises at least one ridge. The at least one ridge 23 is fit formed such that it fits between two of the plurality of ridges of the first member 18. The ridge of the second member 20 corresponds to the channel formed in the first member 18. By this interdigitation, a water-impervious seal is effected. Thus, the opening of the pocket 10 is releasably sealed, A second and alternative embodiment of the means for releasably sealing comprises a slide fastener, commonly known as a zipper (not shown). The slide fastener has a first set of interlockable teeth which are attached to the first panel 12 proximate the upper edge 30. A second set of interlockable teeth are attached to the second panel 14 proximate the upper edge 40. The teeth of the two sets are interdigitatively engaged by the action of a slide. The slide fits around each set of teeth and moves thereover. As the slide moves, the teeth brought into engagement or moved away, depending upon the movement thereof. Such a slide fastener would be water-impervious, thus effecting the water-tight closing.

With reference now to FIG. 5, there is shown a preferred embodiment of the means for fastening. The preferred embodiment comprises a plurality of interlocking ridges 80, 82, 82' which are joined by the action of a slide fastener 70. The fastener 70 has a pair of flanges 72, 72' formed along the edge thereof. The flanges 72, 72' seat in channels 74, 74' formed along the pair of ridges 82, 82'. The base 71 of the fastener 70 rests atop the single ridge 80. A handle 73, comprising means 75 for grasping such as a knob 77, is fixedly secured to the base 71. A loop 79, such as a keychain or the like, carrying a key 81 or the like, may be emplaced around the means 75 for grasping; thus, the knob 77 also serves as means-83 for suspending an item from the slide fastener. As the fastener 70 is slid along the single ridge 80, as by pulling the knob 77 the interlocking, and thus joining, of the ridges 82, 82' is effected. This gives a waterproof seal that is both easily effected or released.

Figure 4:
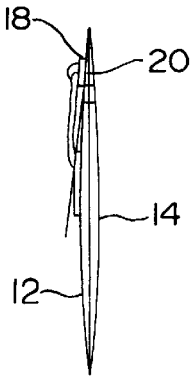
FIG. 4 is a side view of the pocket of the present invention.

With reference now to FIGS. 3 and 4, the pocket 10 may further comprise an attaching flange 22. The flange 22 is formed to the second panel 14 and may be slid into a slot formed in the clothing (not shown) to effect attaching. Also, the flange 22 serves as an additional means for grasping the pocket.

The flange 22 may serve as one means for attaching the pocket 10 to the clothing. Non-removable means for attaching comprise stitching and, less preferably, gluing. Use of Velcro, with one portion adhered to the pocket 10 and one part to the clothing, offers a releasable means of attachment.

As shown in FIG. 6, the pocket 110 may alternately be attached to a belt 120. The belt 120 and pocket 110 are attached thereto each other by similar means for attaching the pocket 10 to the clothing such as stitching, gluing, or other known fastening means. The belt 120 allows deployment of the pocket 10 around the user so that direct attachment to the clothing is unnecessary. The belt 120 may be formed of durable cloth or of sturdy plastic, as desired.

Having thus described the present invention, what is claimed is:

1. A water-impervious pocket comprising:

(a) a first opaque panel formed of a water impervious material;

(b) a second opaque panel formed of a water impervious material, the first panel and the second panel being joined such that an opening is formed therebetween, the opening being in communication with a space formed between the first panel and the second panel;

(c) at least two ridges disposed on the first panel proximate the opening;

(d) a plurality of ridges disposed on the second panel proximate the opening, any two adjacent ridges defining a channel therebetween, there being at least two channels, each channel for seating a ridge of the first panel therewithin;

(e) a slide fastener glidingly disposed on the two panels over the ridges formed thereon, the slide fastener forcing each ridge of the first panel into an associated channel of the second panel, the interdigitation of the ridges effecting a water-impervious seal, the slide fastener including means for grasping and means for suspending an item therefrom.

2. A water-impervious pocket comprising:

(a) a first panel formed of a water impervious material;

(b) a second panel formed of a water impervious material, the first panel and the second panel being joined together such that an opening is formed therebetween, the opening being in communication with a space formed between the first panel and the second panel;

(c) at least two spaced apart ridges disposed on the first panel proximate the opening;

(d) a plurality of ridges disposed on the second panel proximate the opening, any two ridges defining a channel therebetween, the channel for seating a ridge of the first panel therewithin;

(e) a time piece mounted to one of the panels such that the time display is visible through the one panel; and (f) a cover panel having side edges, the cover panel disposed intermediate the first and the second panel and attached to the first panel, such that a space exists between the cover panel and the first panel, the time piece seated in the space.

3. The water-impervious pocket of claim 2 further including means for attaching the pocket to a belt.

4. The water-impervious pocket of claim 3 wherein the means for attaching the pocket to a belt is mounted to the second panel.

* * * * *